US010301794B2

(12) United States Patent
Moriki et al.

(10) Patent No.: US 10,301,794 B2
(45) Date of Patent: May 28, 2019

(54) CONSTRUCTION MACHINE

(71) Applicant: HITACHI CONSTRUCTION MACHINERY CO., LTD., Tokyo (JP)

(72) Inventors: Hidekazu Moriki, Tokyo (JP); Hiroyuki Yamada, Tokyo (JP); Manabu Edamura, Tsuchiura (JP); Hiroshi Sakamoto, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 15/451,459

(22) Filed: Mar. 7, 2017

(65) Prior Publication Data

US 2017/0284057 A1 Oct. 5, 2017

(30) Foreign Application Priority Data

Mar. 31, 2016 (JP) ..... 2016-070625

(51) Int. Cl.
*E02F 3/43* (2006.01)
*E02F 9/20* (2006.01)
(Continued)

(52) U.S. Cl.
CPC ..... *E02F 3/439* (2013.01); *E02F 3/32* (2013.01); *E02F 9/2004* (2013.01);
(Continued)

(58) Field of Classification Search
CPC ..... E02F 1/00; E02F 3/00; E02F 3/30; E02F 3/32; E02F 3/325; E02F 3/43;
(Continued)

(56) References Cited

U.S. PATENT DOCUMENTS 6,108,948 A * 8/2000 Tozawa ..... E02F 3/435 172/2
2005/0027420 A1* 2/2005 Fujishima ..... E02F 9/2045 701/50

(Continued)

FOREIGN PATENT DOCUMENTS

JP 2006-265954 A 10/2006
JP 5654144 B1 11/2014

OTHER PUBLICATIONS

Korean Office Action received in corresponding Korean Application No. 10-2017-0022288 dated Jan. 11, 2018.

*Primary Examiner* — Peter D Nolan
*Assistant Examiner* — Sara J Lewandroski
(74) *Attorney, Agent, or Firm* — Mattingly & Malur, PC

(57) ABSTRACT

A construction machine acquires efficiently and accurately the target surface to be displayed or controlled. The construction machine includes: a design surface information storage unit storing three-dimensional target shape as multiple design surfaces; a work equipment velocity vector acquisition unit detecting or estimating the velocity of work equipment; a work equipment position acquisition unit detecting or estimating the position of the work equipment; a target surface acquisition unit acquiring a principal target surface to acquire an estimated target surface that is potentially the next principal target surface; an operation control unit correcting the work equipment velocity; and a display unit displaying the positional relations between the work equipment position and the principal target surface. The target surface acquisition unit includes an estimated target surface calculation unit determining as an estimated target surface the design surface located in the direction of the work equipment velocity vector.

4 Claims, 19 Drawing Sheets

(51) Int. Cl.
*E02F 9/26* (2006.01)
*E02F 3/32* (2006.01)

(52) U.S. Cl.
CPC ..... *E02F 9/2041* (2013.01); *E02F 9/262* (2013.01); *E02F 9/265* (2013.01)

(58) Field of Classification Search
CPC ..... E02F 3/431; E02F 5/00; E02F 5/14; E02F 5/145; E02F 9/20; E02F 9/2004; E02F 9/26; E02F 9/261; E02F 9/264; G07C 5/00; G07C 5/08; G07C 5/0816; G07C 5/0825; G07C 5/0833; G07C 5/12
See application file for complete search history.

(56) References Cited

U.S. PATENT DOCUMENTS

2013/0158784 A1* 6/2013 Fukano ..... E02F 9/2033 701/34.4
2013/0158785 A1* 6/2013 Fukano ..... E02F 9/261 701/34.4
2013/0158787 A1* 6/2013 Nomura ..... E02F 9/264 701/34.4
2013/0158788 A1* 6/2013 Seki ..... E02F 9/264 701/34.4
2013/0158789 A1* 6/2013 Seki ..... E02F 9/264 701/34.4
2013/0158797 A1* 6/2013 Fukano ..... E02F 9/264 701/36
2013/0166143 A1* 6/2013 Seki ..... E02F 9/264 701/34.4
2013/0302124 A1* 11/2013 Matsuyama ..... E02F 3/435 414/687
2014/0099178 A1* 4/2014 Nomura ..... E02F 3/32 414/685
2014/0100712 A1* 4/2014 Nomura ..... E02F 3/32 701/1
2014/0100744 A1* 4/2014 Johnson ..... E02F 3/32 701/50
2014/0142817 A1* 5/2014 Matsuyama ..... E02F 3/437 701/50
2014/0174770 A1* 6/2014 Wei ..... E02F 3/841 172/2
2015/0218781 A1* 8/2015 Nomura ..... E02F 3/435 701/50
2015/0345114 A1* 12/2015 Nomura ..... E02F 3/3677 37/379
2016/0010312 A1* 1/2016 Kurihara ..... E02F 3/435 701/36
2016/0024757 A1* 1/2016 Nomura ..... E02F 3/435 414/687
2016/0040398 A1* 2/2016 Kitajima ..... E02F 3/435 701/50
2016/0097184 A1* 4/2016 Matsuyama ..... E02F 3/28 701/50
2016/0138240 A1* 5/2016 Ikegami ..... E02F 9/2285 701/50
2016/0237654 A1* 8/2016 Arimatsu ..... E02F 9/26
2016/0237655 A1* 8/2016 Baba ..... E02F 3/437
2016/0251824 A1* 9/2016 Arimatsu ..... E02F 3/435 701/50
2016/0251834 A1* 9/2016 Arimatsu ..... E02F 3/435 414/687
2016/0258135 A1* 9/2016 Shimano ..... E02F 3/435
2016/0289928 A1* 10/2016 Kitajima ..... E02F 3/32
2016/0376772 A1* 12/2016 Kondo ..... E02F 9/264 701/34.4
2017/0101761 A1* 4/2017 Wu ..... E02F 9/20
2017/0175362 A1* 6/2017 Iwanaga ..... E02F 3/435
2017/0175364 A1* 6/2017 Hasegawa ..... E02F 9/261
2018/0030694 A1* 2/2018 Kanari ..... E02F 9/26

* cited by examiner

PRIOR ART

PRIOR ART

PRIOR ART

CONSTRUCTION MACHINE

BACKGROUND OF THE INVENTION

1. Field of the Invention

The present invention relates to a construction machine.

2. Description of the Related Art

Excavation support devices are known to support the operator's operation of a construction machine in the excavating work using the machine to form the original shape into three-dimensional target shape. Such excavation support devices typically include, in place of the existing finishing stake for construction, machine guidance that replaces with a monitor for displaying positional relations between the target shape and the work equipment of the construction machine, and machine control that controls the construction machine in semi-automatic fashion in accordance with positional deviations between the target shape and the work equipment.

These excavation support devices store the three-dimensional target shape in the form of information about multiple design surfaces. A target surface to be displayed or controlled is acquired as needed from the information about these multiple design surfaces.

JP-2006-265954-A (hereinafter referred to as Patent Document 1) discloses a target working surface setting device equipped with a target working surface calculating means for calculating a target surface (described as "target working surface" in Patent Document 1) on the basis of electronic data about positions, shapes, and dimensions of the structure to be built. A work machine equipped with the target working surface setting device described in Patent Document 1 sets the design surface closest to the work equipment as the target surface to be controlled, and limits the velocity of the work equipment in a direction in which the work equipment intrudes into the target surface. This prevents the work equipment from intruding into the target surface during excavation work.

SUMMARY OF THE INVENTION

The existing technology such as the target working surface calculating means described in Patent Document 1 involves acquiring the target surface to be displayed or controlled from multiple design surfaces on the basis of the position of the work equipment of the hydraulic excavator. This technology has incurred the following problems.

A method of acquiring the target surface according to the existing technology is explained below using FIGS. 14A and 14B. FIG. 14A is a flowchart showing the processing sequence of the target surface acquisition method with an existing excavation support device. FIG. 14B is a conceptual view explanatory of the process of the target surface acquisition method with the existing excavation support device. According to the existing technology, the design surface closest to the work equipment of the hydraulic excavator is extracted as the target surface using the processing sequence shown in FIG. 14A. Points P0 to P8 constituting a point group shown in FIG. 14B represent a coordinate point group indicative of design surfaces. Point Pw denotes a feature point on the work equipment (e.g., center point of the bucket tip).

In step S001, the vectors necessary for calculating the distances between points and surfaces are set. For example, the vectors from point P0 to each of points P1, P2, and Pw are set. In step S002, on the basis of the cross product of the vectors from point P0 to point P1 and to point P2, a normal vector n relative to a surface P0P1P2 is calculated. In step S003, on the basis of the inner product of the normal vector n and the vector from point P0 to point Pw, the distance between point Pw and the surface P0P1P2 (i.e., distance from point Pw to point Pw') is calculated. In step S004, the vectors from points P0, P1 and P2 to point Pw' are set, and the cross products of these vectors are calculated. If the directions of the cross products all coincide with one another, it is determined that point Pw' is inside the surface P0P1P2. These steps are also performed on the other design surfaces. In step S005, the design surface having point Pw' therein and closest to point Pw is extracted as the target surface. The distance from point Pw to point Pw' is called the principal target surface distance.

The existing target surface acquisition method requires that step S001 to step S004 above be carried out as many times as the number of design surfaces in a single control cycle. The processing load involved is high and efficiency is low, which are problems with the existing method.

According to the above-described existing technology, only the design surface closest to the work equipment is acquired as the target surface to be displayed or controlled. Thus there is a possibility that the work equipment may intrude into some other design surface. How the target surface acquisition method according to the existing technology above operates is explained below with reference to FIG. 15. FIG. 15 is a conceptual view explanatory of the operations of the target surface acquisition method with the existing excavation support device.

FIG. 15 shows a cross-sectional shape of a road along which a drain ditch is to be constructed. The shading in FIG. 15 indicates the present shape. Reference characters S1 to S7 in FIG. 15 indicate the cross sections of design surfaces. To build the present shape into such shape involves first working on the design surfaces S1, S5 and S6 with the work equipment operating in the direction of the arrow in FIG. 15. In this case, according to the existing target surface acquisition method, the design surfaces S1, S2, S3 and S4 are selected successively as the target surface as the work equipment moves on. When the work equipment arrives at point P in FIG. 15, the design surface S5 is selected as the target surface.

Past point P, the work equipment advances straight toward the design surface S5. After the design surface S5 is selected as the target surface, the work equipment may intrude into the design surface S5 because the work equipment cannot be decelerated in time while moving in the direction of the target surface.

The present invention has been made in view of the above circumstances and provides as an object a construction machine that acquires efficiently and accurately the target surface to be displayed or controlled.

To solve the above-described problems, there may be adopted, for example, the structures described in the appended claims of this application. This application includes multiple means for solving the above-described problem, one such means being a construction machine that includes: a vehicle body; work equipment having a boom attached tiltably to the vehicle body, an arm attached tiltably to the boom, and a bucket attached tiltably to the arm; a control lever device configured to operate the boom, the arm, and the bucket; and a design surface information storage unit configured to store three-dimensional target shape as a plurality of design surfaces. The construction machine further includes: a work equipment velocity vector acquisition unit configured to detect or estimate the velocity vector of the work equipment on the basis of an operation amount of the control lever device; a work equipment position acquisition unit configured to detect or estimate the work equipment position defined as the feature point on the work equipment; and a target surface acquisition unit configured to acquire a principal target surface from the design surfaces stored in the design surface information storage unit on the basis of the work equipment position detected or estimated by the work equipment position acquisition unit and on the basis of the velocity vector of the work equipment detected or estimated by the work equipment velocity vector acquisition unit, the target surface acquisition unit further acquiring an estimated target surface that is potentially the next principal target surface on the basis of the design surfaces. The target surface acquisition unit includes an estimated target surface calculation unit configured to determine as the estimated target surface the design surface located in the direction of the velocity vector of the work equipment on the basis of the work equipment position.

The present invention envisages acquiring as the target surface one of multiple design surfaces that is highly likely to come into contact with the work equipment. This permits efficient and accurate acquisition of the target surface to be displayed or controlled.

DESCRIPTION OF THE PREFERRED EMBODIMENTS

Some preferred embodiments of the construction machine according to the present invention are described below with reference to the accompanying drawings.

First Embodiment

Figure 1:
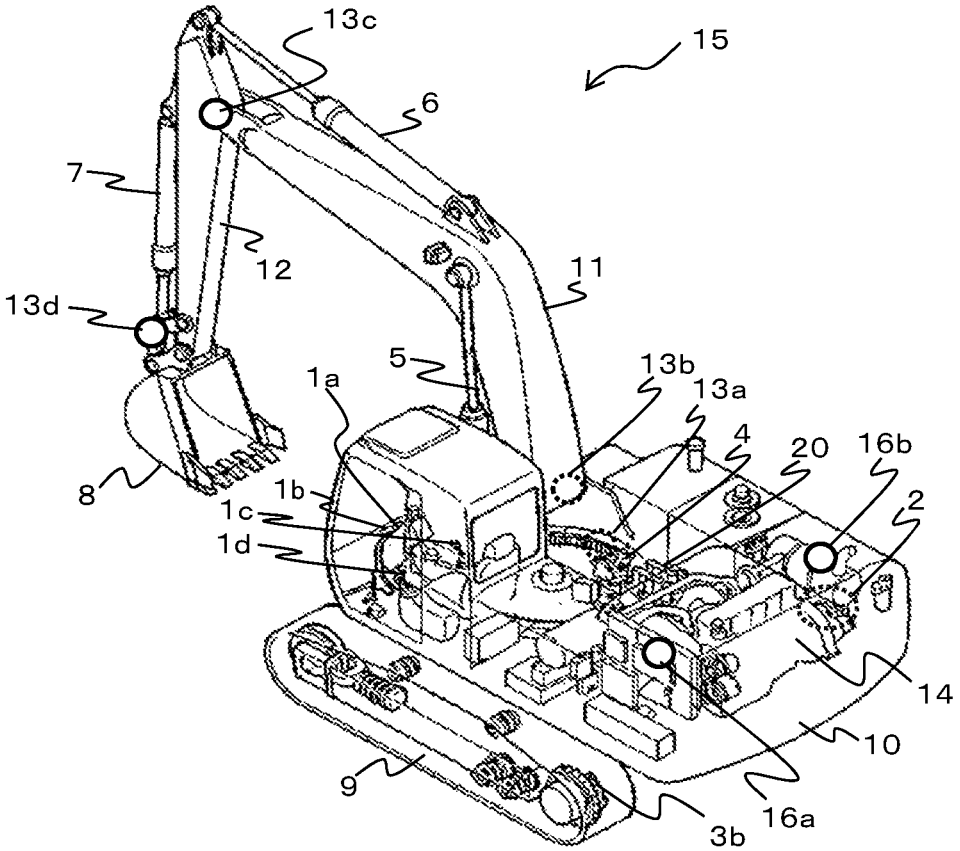
FIG. 1 is a perspective view showing a hydraulic excavator having a first embodiment of a construction machine according to the present invention.

FIG. 1 is a perspective view showing a first embodiment of a construction machine according to the present invention. As shown in FIG. 1, the hydraulic excavator 1 includes a lower track structure 9, an upper swing structure 10, and work equipment 15. The lower track structure 9 has right and left crawler travel devices driven by right and left traveling hydraulic motors 3*a* and 3*b*, respectively (the left traveling hydraulic motor 3*b* alone is shown). The upper swing structure 10 is mounted swingably on the lower track structure 9 and driven swingably by a swing hydraulic motor 4. The upper swing structure 10 is equipped with an engine 14 acting as a prime mover and a hydraulic pump device 2 driven by the engine 14. The lower track structure 9 and the upper swing structure 10 constitute the vehicle body.

The work equipment 15 is attached tiltably to the front of the upper swing structure 10 constituting the vehicle body. The upper swing structure 10 has a cabin in which are disposed operating devices such as a right travel control lever device 1*a*, a left travel control lever device 1*b*, and right and left control lever devices 1*c* and 1*d* for designating the operations and swing actions of the work equipment 15.

The work equipment 15 has an articulated structure including a boom 11, an arm 12, and a bucket 8. A boom cylinder 5 moves telescopically to tilt the boom 11 in the vertical direction relative to the upper swing structure 10. An arm cylinder 6 moves telescopically to tilt the arm 12 in the vertical and in the front-back directions relative to the boom 11. A bucket cylinder 7 moves telescopically to tilt the bucket 8 in the vertical and in the front-back directions relative to the arm 12.

To calculate the position at a given point of the work equipment 15, four inertial sensors are provided: a first inertial sensor 13*a* that detects the inclination angles (roll angle and pitch angle) of the upper swing structure 10 and its swing angular velocity relative to the horizontal surface; a second inertial sensor 13*b* that is disposed near a coupling part between the upper swing structure 10 and the boom 11 and that detects the angle of the boom 11 (boom angle) relative to the horizontal surface; a third inertial sensor 13*c* that is disposed near a coupling part between the boom 11 and the arm 12 and that detects the angle of the arm 12 (arm angle) relative to the horizontal surface; and a fourth inertial sensor 13*d* that is disposed near a coupling part between the arm 12 and the bucket 8 and that detects the angle of the bucket 8 (bucket angle) relative to the horizontal surface. Signals representing the angles and angular velocity detected by the first through the fourth inertial sensors 13*a* through 13*d* are input to a controller 100, to be discussed later.

Global Navigation Satellite System (GNSS) antennas 16*a* and 16*b* are mounted on the upper swing structure 10 with a view to acquiring the position and orientation of the vehicle body. The GNSS antennas 16*a* and 16*b* receive signals typically from satellites and send the received signals to a positioning unit 200, to be discussed later.

A control valve 20 is provided to control the flows (i.e., flow rates and directions) of hydraulic fluid supplied from the hydraulic pump device 2 to hydraulic actuators such as the above-mentioned swing hydraulic motor 4, boom cylinder 5, arm cylinder 6, bucket cylinder 7, and right and left traveling hydraulic motors 3*a* and 3*b*.

Excavation Support Device

Figure 2:
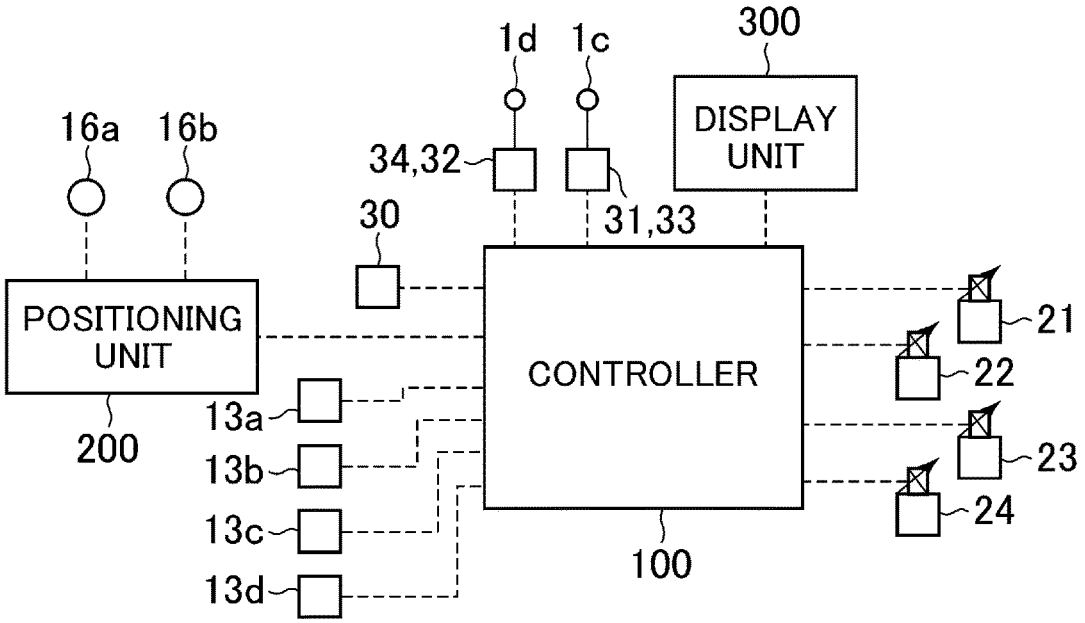
FIG. 2 is a block diagram showing the first embodiment of the construction machine according to the present invention.

FIG. 2 is a block diagram showing the first embodiment of the construction machine according to the present invention. In FIG. 2, an excavation support device includes a controller 100, a positioning unit 200, and a display unit 300. The positioning unit 200 calculates the position and orientation of the vehicle body on the basis of the signals received by the GNSS antennas 16*a* and 16*b* typically from satellites. The vehicle body position and vehicle body orientation thus calculated are sent to the controller 100.

The controller 100 receives the vehicle body position and vehicle body orientation calculated by the positioning unit 200. The controller 100 inputs followings: design surface information from a design surface information input part 30; a boom operation signal and a bucket operation signal respectively from operation amount detection sensors 31 and 33 attached to the right control lever device 1*c*; and an arm operation signal and a swing operation signal respectively from operation amount detection sensors 32 and 34 attached to the left control lever device 1*d*. Also, the controller 100 inputs followings: the vehicle body roll angle, vehicle body pitch angle, and swing angular velocity from the first inertial sensor 13*a*; the boom angle from the second inertial sensor 13*b*; the arm angle from the third inertial sensor 13*c*; and the bucket angle from the fourth inertial sensor 13*d*.

The controller 100 performs calculations on the basis of these input signals and sends the results of the calculations to the display unit 300. On the basis of the calculation results, the controller 100 further transmits a boom raising acceleration signal to a boom raising proportional solenoid valve 21, a boom lowering deceleration signal to a boom lowering proportional solenoid valve 22, an arm crowding deceleration signal to an arm crowding proportional solenoid valve 23, and an arm damping deceleration signal to an arm damping proportional solenoid valve 24.

Details of the calculations performed by the controller 100 and detailed contents of display given by the display unit 300 will be discussed later. The calculations carried out by the positioning unit 200 are the same as those done by existing positioning units and thus will not be discussed further. The delivery ports of the boom raising proportional solenoid valve 21, boom lowering proportional solenoid valve 22, arm crowding proportional solenoid valve 23, and arm damping proportional solenoid valve 24 are connected to the control valve 20. The hydraulic fluid delivered from the solenoid valves drives a directional control valve in the control valve 20. The connection relations between the solenoid valves on one hand and the control valve 20 on the other hand are the same as with the existing technology and thus will not be explained in detail.

Controller

Figure 3:
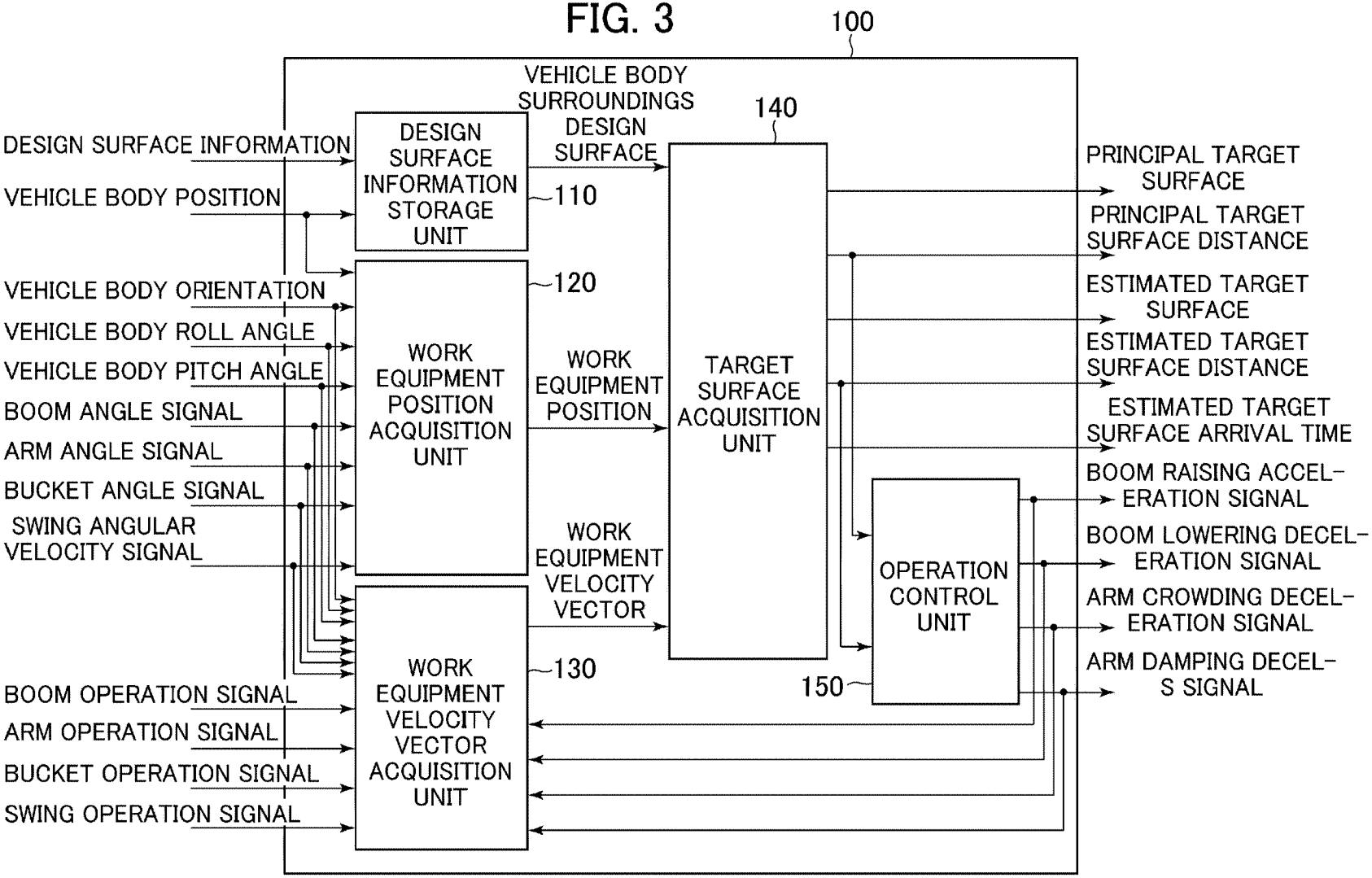
FIG. 3 is a block diagram showing a controller constituting as part of the first embodiment of the construction machine according to the present invention.
Figure 4:
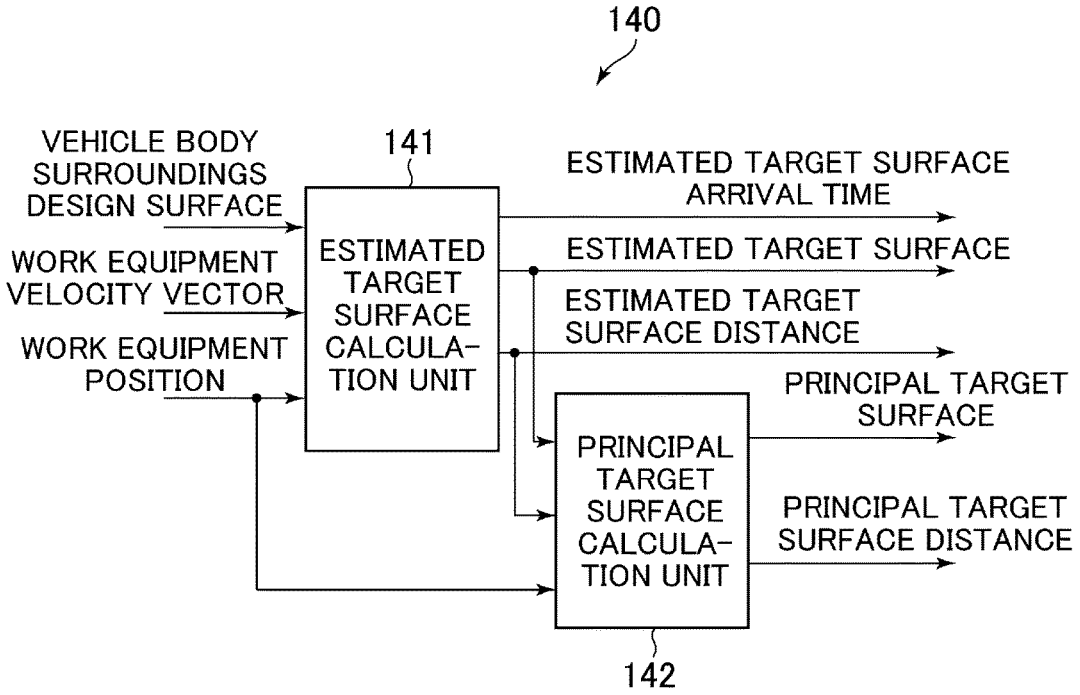
FIG. 4 is a block diagram showing a target surface acquisition unit of the controller as part of the first embodiment of the construction machine according to the present invention.

The controller 100 constituting part of the first embodiment of the construction machine according to the present invention is described below using the accompanying drawings. FIG. 3 is a block diagram showing the controller as part of the first embodiment of the construction machine according to the present invention. FIG. 4 is a block diagram showing a target surface acquisition unit of the controller as part of the first embodiment of the construction machine according to the present invention.

As shown in FIG. 3, the controller 100 includes a design surface information storage unit 110, a work equipment position acquisition unit 120, a work equipment velocity vector acquisition unit 130, a target surface acquisition unit 140, and an operation control unit 150.

The design surface information storage unit 110 inputs a design surface information signal from the design surface information input part 30 and a vehicle body position signal from the positioning unit 200. The design surface information storage unit 110 then determines a vehicle body surroundings design surface signal by selecting from the design surface information signal the design surface including the coordinate points close to the vehicle body position. The design surface information storage unit 110 proceeds to output the vehicle body surroundings design surface signal to the target surface acquisition unit 140.

As with the existing technology, the work equipment position acquisition unit 120 inputs followings: the vehicle body position signal and a vehicle body orientation signal from the positioning unit 200; the vehicle body roll angle, vehicle body pitch angle, and swing angular velocity from the first inertial sensor 13*a*; the boom angle from the second inertial sensor 13*b*; the arm angle from the third inertial sensor 13*c*; and the bucket angle from the fourth inertial sensor 13*d*. The work equipment position acquisition unit 120 proceeds to calculate a work equipment position signal indicative of the position of the feature point on the work equipment (e.g., tip center of the bucket 8) in a three-dimensional coordinate system defining design surfaces and to output the work equipment position signal to the target surface acquisition unit 140. Although the work equipment position signal is described here as being estimated by calculation for example, this is not limitative of the present invention. Alternatively, a signal representing a directly detected work equipment position may be used as the work equipment position signal.

The work equipment velocity vector acquisition unit 130 inputs followings: the boom operation signal from the operation amount detection sensor 31; the arm operation signal from the operation amount detection sensor 32; the bucket operation signal from the operation amount detection sensor 33; the swing operation signal from the operation amount detection sensor 34; and the boom raising acceleration signal, boom lowering deceleration signal, arm crowding deceleration signal, and arm damping deceleration signal from the operation control unit 150 to be discussed later. The work equipment velocity vector acquisition unit 130 proceeds to calculate a work equipment velocity vector signal indicative of the feature point on the work equipment (referred to as the work equipment position hereunder) in the three-dimensional coordinate system defining design surfaces. The work equipment velocity vector acquisition unit 130 outputs the work equipment velocity vector signal thus calculated to the target surface acquisition unit 140. Although the velocity signal of the work equipment 15 is described here as being estimated by vector calculation for example, this is not limitative of the present invention. Alternatively, a signal representing a directly detected velocity of the work equipment 15 may be used as the velocity signal.

The target surface acquisition unit 140 inputs the vehicle body surroundings design surface signal from the design surface information storage unit 110, the work equipment position signal from the work equipment position acquisition unit 120, and the work equipment velocity vector signal from the work equipment velocity vector acquisition unit 130. The target surface acquisition unit 140 proceeds to calculate a principal target surface, a principal target surface distance, an estimated target surface, an estimated target surface distance, and an estimated target surface arrival time. The target surface acquisition unit 140 sends the signals thus calculated to the display unit 300, and outputs the principal target surface distance and the estimated target surface distance to the operation control unit 150.

The operation control unit 150 inputs the principal target surface distance signal and the estimated target surface distance signal from the target surface acquisition unit 140. The operation control unit 150 proceeds to calculate and output the boom raising acceleration signal, boom lowering deceleration signal, arm crowding deceleration signal, and arm damping deceleration signal, thereby driving the boom raising proportional solenoid valve 21, boom lowering proportional solenoid valve 22, arm crowding proportional solenoid valve 23, and arm damping proportional solenoid valve 24, respectively. The operation control unit 150 further outputs the signals thus calculated to the work equipment velocity vector acquisition unit 130.

Target Surface Acquisition Unit

As shown in FIG. 4, the target surface acquisition unit 140 includes an estimated target surface calculation unit 141 and a principal target surface calculation unit 142.

The estimated target surface calculation unit 141 inputs the vehicle body surroundings design surface signal from the design surface information storage unit 110, the work equipment position signal from the work equipment position acquisition unit 120, and the work equipment velocity vector signal from the work equipment velocity vector acquisition unit 130. The estimated target surface calculation unit 141 proceeds to calculate the estimated target surface, estimated target surface distance, and estimated target surface arrival time. The estimated target surface calculation unit 141 outputs the signals thus calculated.

The principal target surface calculation unit 142 inputs an estimated target surface signal and an estimated target surface distance signal from the estimated target surface calculation unit 141 and the work equipment position signal from the work equipment position acquisition unit 120. The principal target surface calculation unit 142 proceeds to calculate the principal target surface and the principal target surface distance, and outputs the signals thus calculated.

Figure 5A:
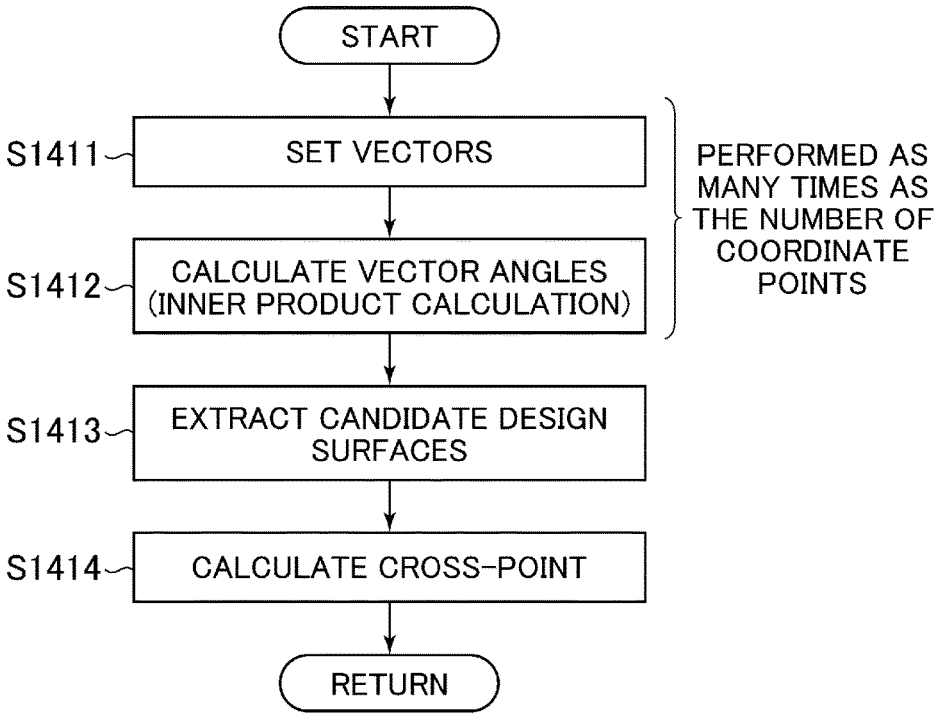
FIG. 5A is a flowchart showing the processing sequence of an estimated target surface calculation unit as part of the first embodiment of the construction machine according to the present invention.
Figure 5B:
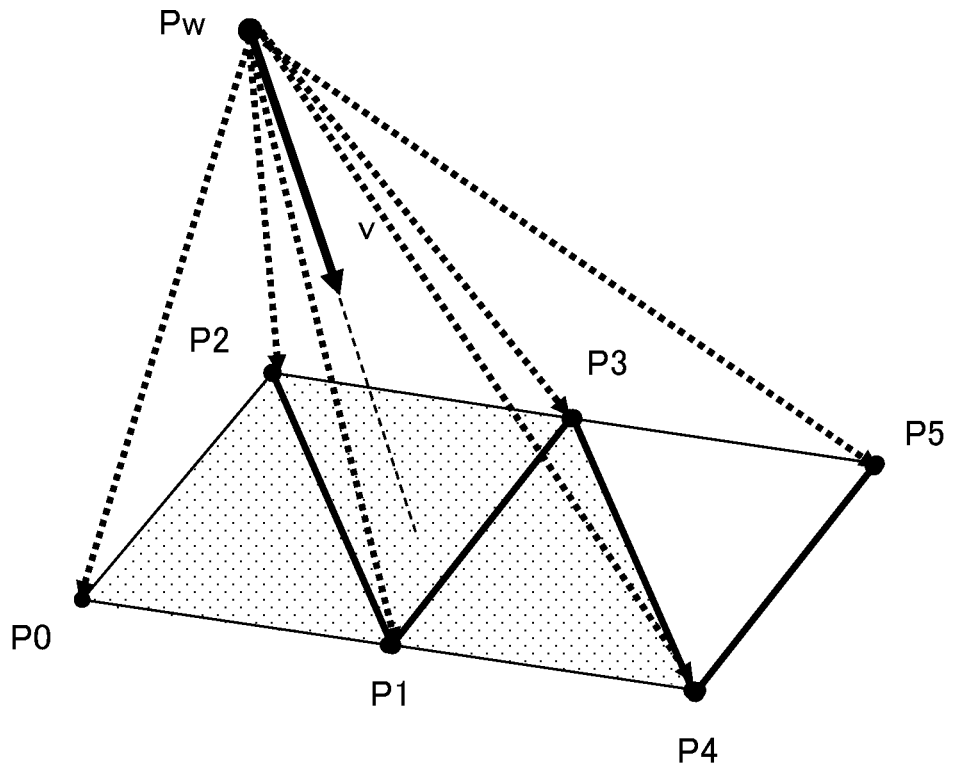
FIG. 5B is a conceptual view explanatory of a typical process performed by the estimated target surface calculation unit as part of the first embodiment of the construction machine according to the present invention.
Figure 5C:
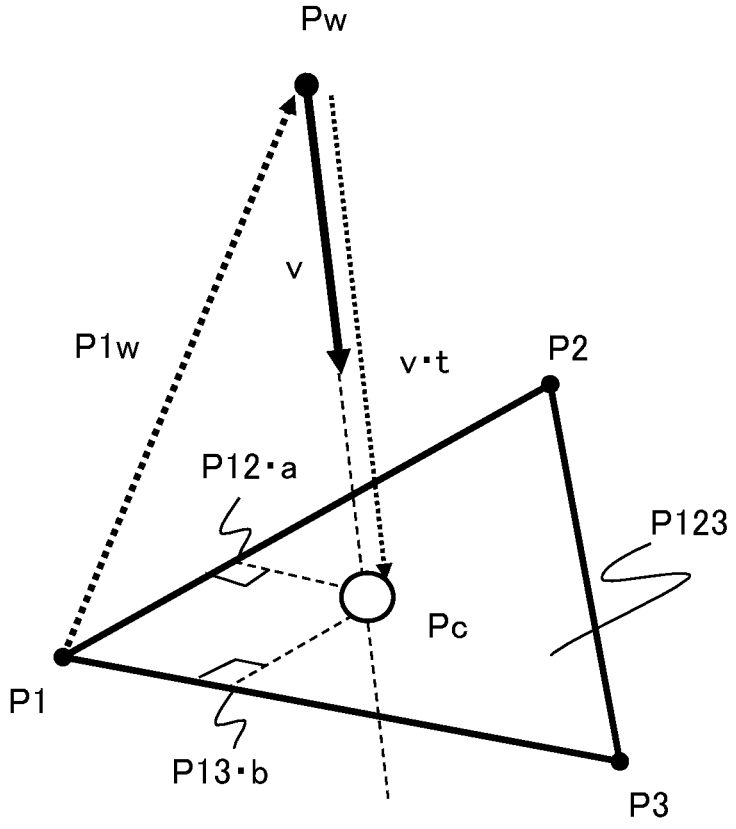
FIG. 5C is a conceptual view explanatory of a cross-point calculation process performed by the estimated target surface calculation unit as part of the first embodiment of the construction machine according to the present invention.

An example of the calculations performed by the estimated target surface calculation unit 141 is described below using FIGS. 5A, 5B and 5C. FIG. 5A is a flowchart showing the processing sequence of the estimated target surface calculation unit as part of the first embodiment of the construction machine according to the present invention. FIG. 5B is a conceptual view explanatory of a typical process performed by the estimated target surface calculation unit as part of the first embodiment of the construction machine according to the present invention. FIG. 5C is a conceptual view explanatory of a cross-point calculation process performed by the estimated target surface calculation unit as part of the first embodiment of the construction machine according to the present invention.

Using the processing sequence shown in FIG. 5A, the estimated target surface calculation unit 141 of the first embodiment acquires as the estimated target surface a design surface highly likely to come into contact with the work equipment 15. Points P0 to P5 constituting a point group shown in FIGS. 5B and 5C represent a coordinate point group indicative of design surfaces. Point Pw denotes the feature point on the work equipment (e.g., center point of the bucket tip).

In step S1411, vectors are set. Specifically, as shown in FIG. 5B, what is set are coordinate point directional vectors from point Pw, which is the feature point on the work equipment, to each of coordinate points P0 to P5 (indicated by dotted-line arrows in FIG. 5B) representative of design surfaces.

In step S1412, vector angle calculations are performed. Specifically, as shown in FIG. 5B, on the basis of the inner product of a work equipment velocity vector v as the velocity vector of point Pw and each of the coordinate point directional vectors, the angles between the vectors are calculated.

In step S1413, candidate design surfaces are extracted. Generally, the smaller the angle between two vectors, the more the vectors approach the same direction. Thus in this step, on the basis of the angle between the work equipment velocity vector v as the velocity vector of point Pw calculated in step S1412 and each of the coordinate point directional vectors, the design surfaces each including the coordinate points constituting the coordinate point directional vectors having the smallest angle are extracted as the candidate design surfaces.

In step S1414, using Tomas Moller's known intersection determination method, an estimated target surface is selected from the candidate design surfaces. The processing of step S1414 is explained below in detail using FIG. 5C. In FIG. 5C, it is assumed that reference character Pc stands for the cross-point between the work equipment velocity vector v and a candidate design surface P1P2P3, P12 for the vector from coordinate point P1 to coordinate point P2, P13 for the vector from coordinate point P1 to coordinate point P3, and P1$w$ for the vector from coordinate point P1 to point Pw. On that assumption, the cross-point Pc is given by the following mathematical expressions (1) and (2):

$$Pc=P12\cdot a+P13\cdot b \quad (1)$$

$$Pc=P1w+v\cdot t \quad (2)$$

where, a, b, and t represent the ratios by which the vectors P12, P13, and v are multiplied respectively.

If the mathematical expressions (1) and (2) above are considered a system of equations, they may be rearranged into a mathematical expression (3) below. The ratios a, b, and t are then calculated from the vectors P12, P13, P1$w$, and $v$.

$$[a\ b\ t]^T=[P12\ P13-v]^{-1}\cdot P1w \quad (3)$$

If the ratios a and b are each equal to or larger than 0 and if the sum of these ratios is equal to or smaller than 1, then it is determined that the cross-point Pc is within the candidate design surface P1P2P3 and that the candidate design surface P1P2P3 is the estimated target surface. Since the vector v is the work equipment velocity vector, the ratio t represents the estimated target surface arrival time, i.e., the time it takes for the work equipment to arrive at the cross-point Pc. The product of the work equipment velocity vector v and the ratio t denotes the estimated target surface distance. If none of the candidate design surfaces is the estimated target surface, then it is determined that the estimated target surface does not exist. In this case, the estimated target surface arrival time and the estimated target surface distance are output as invalid values. At this time, the estimated target surface distance is handled as a maximum value in the calculations.

As shown in FIG. 5A, the estimated target surface calculation unit 141 in the present embodiment performs steps S1411 and S1412 alone as many times as the number of coordinate points in one control cycle. With the existing target surface acquisition method, it is necessary to perform cross product calculation twice and inner product calculation once. With the present embodiment of the present invention, by contrast, inner product calculation is performed only once. The cross-point is determined after the design surfaces have been narrowed down to the candidate design surfaces. This means the processing load involved is lower than with the existing target surface acquisition method and that the efficiency of the embodiment is higher than the existing method.

Figure 6:
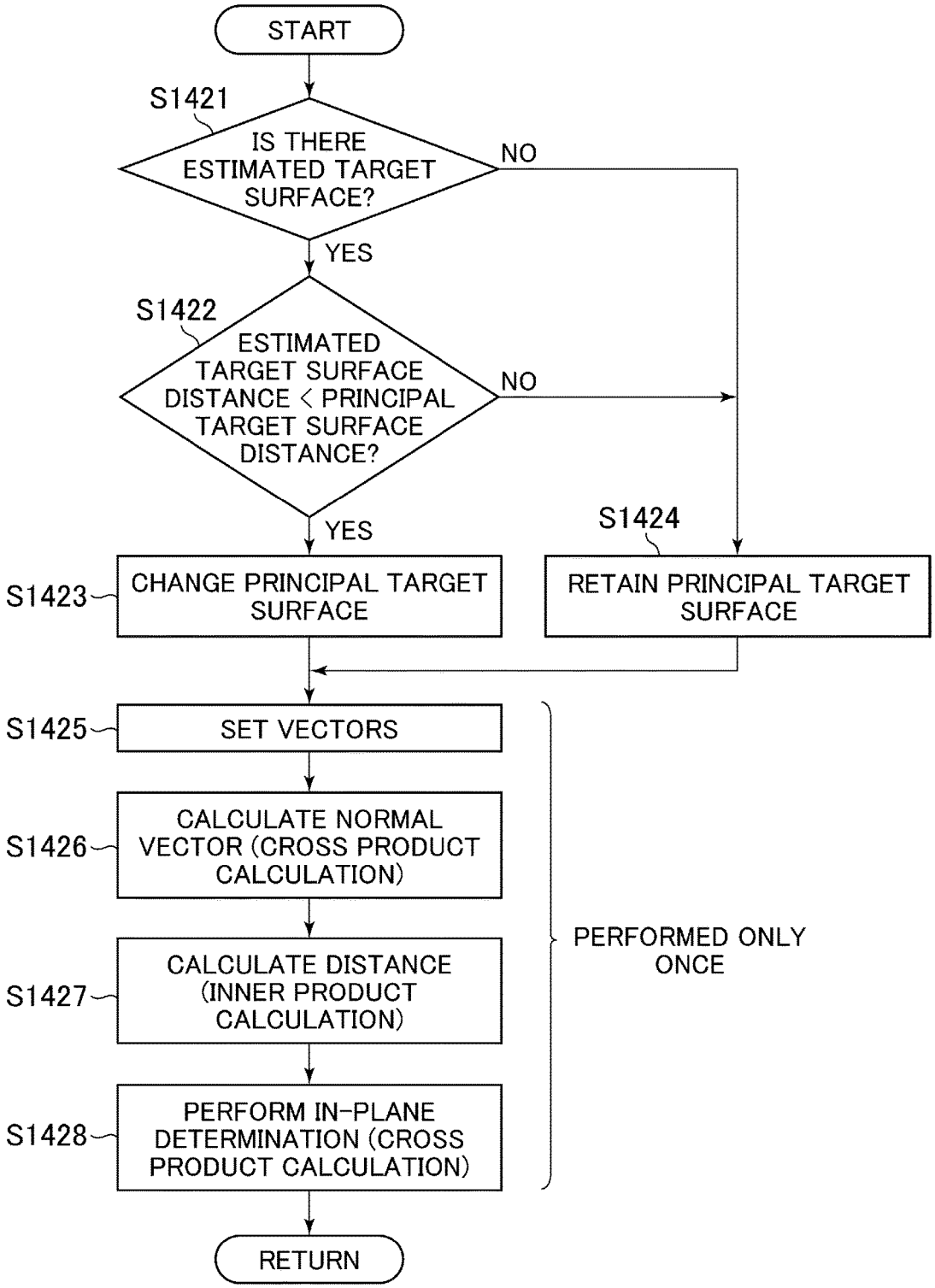
FIG. 6 is a flowchart showing the processing sequence of a principal target surface calculation unit as part of the first embodiment of the construction machine according to the present invention.

An example of the calculations performed by the principal target surface calculation unit 142 is described below using FIG. 6. FIG. 6 is a flowchart showing the processing sequence of the principal target surface calculation unit as part of the first embodiment of the construction machine according to the present invention. Using the processing sequence shown in FIG. 6, the principal target surface calculation unit 142 of the first embodiment acquires the principal target surface from multiple design surfaces stored in the design surface information storage unit 110 on the basis of the work equipment position. Also, the principal target surface calculation unit 142 retains or changes the principal target surface depending on the distance between the estimated target surface and the principal target surface that is the design surface closest to the work equipment 15 in the preceding control cycle.

In step S1421, the principal target surface calculation unit 142 determines whether there is an estimated target surface. Specifically, the principal target surface calculation unit 142 determines whether the estimated target surface signal is received from the estimated target surface calculation unit 141. If it is determined that the estimated target surface exists, the principal target surface calculation unit 142 goes to step S1422. Otherwise the principal target surface calculation unit 142 goes to step S1424.

In step S1422, the principal target surface calculation unit 142 compares the estimated target surface distance with the principal target surface distance of the preceding control cycle, to see if the estimated target surface distance is shorter than the principal target surface distance of the preceding control cycle. If the estimated target surface distance is determined to be shorter than the principal target surface distance of the preceding control cycle, the principal target surface calculation unit 142 goes to step S1423. Otherwise the principal target surface calculation unit 142 goes to step S1424.

In step S1423, the principal target surface calculation unit 142 performs principal target surface changeover, changing the estimated target surface to a new principal target surface. If in step S1422 the estimated target surface distance is determined to be not shorter than the principal target surface distance of the preceding control cycle, or if in step S1421 the estimated target surface is determined to be absent, the principal target surface calculation unit 142 goes to step S1424 and retains the principal target surface of the preceding control cycle as the principal target surface.

Figure 14A:
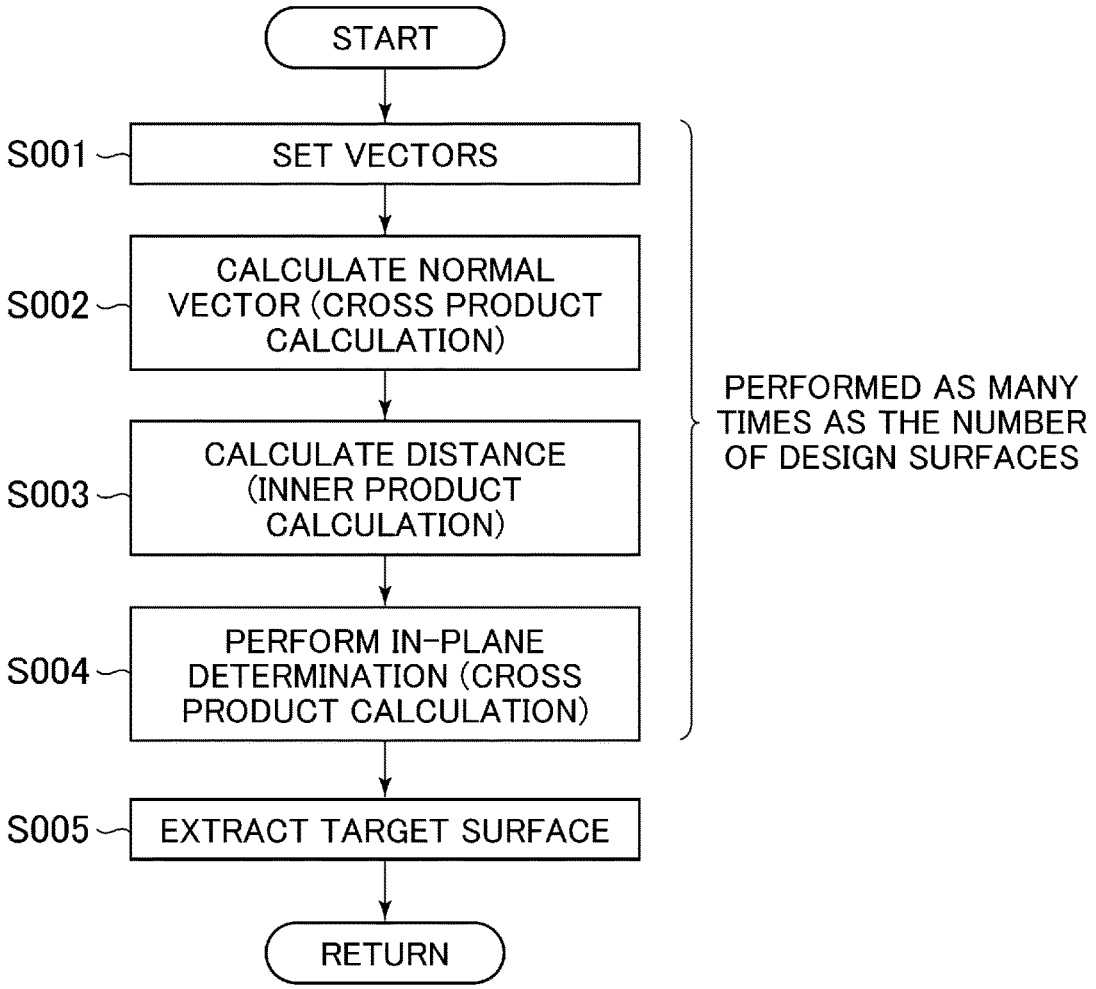
FIG. 14A is a flowchart showing the processing sequence of a target surface acquisition method with an existing excavation support device.
Figure 14B:
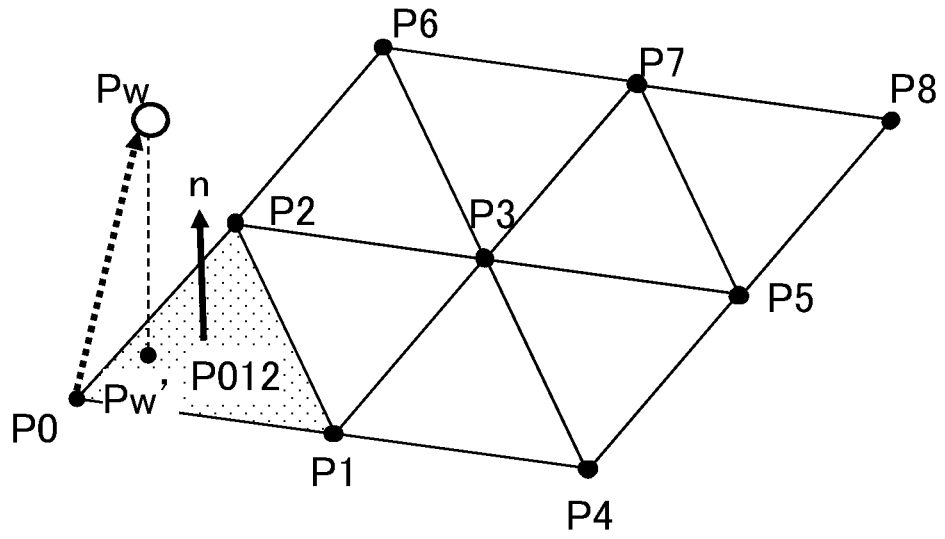
FIG. 14B is a conceptual view explanatory of a typical process of the target surface acquisition method with the existing excavation support device.

In steps S1425, S1426, S1427 and S1428, the principal target surface calculation unit 142 performs the same calculations as in steps S001, S002, S003 and S004 of FIG. 14A explained above in connection with the existing target surface acquisition method. In so doing, the principal target surface calculation unit 142 calculates the principal target surface distance. If the design surface corresponding to the principal target surface is determined to be absent in the in-plane determination of step S1428, then the principal target surface distance is output as an invalid value with no principal target surface obtained. At this time, the principal target surface distance is handled as a maximum value in the calculations.

In the first embodiment, the principal target surface calculation unit 142 performs steps S1425 to S1428 only once during one control cycle. The processing load involved is thus lower than with the existing target surface acquisition method or with the estimated target surface calculation unit 141 of the first embodiment.

Further, the estimated target surface acquired as the design surface highly likely to come into contact with the work equipment 15 is set to be the new principal target surface. This permits accurate acquisition of the target surface to be displayed or controlled.

Figure 7A:
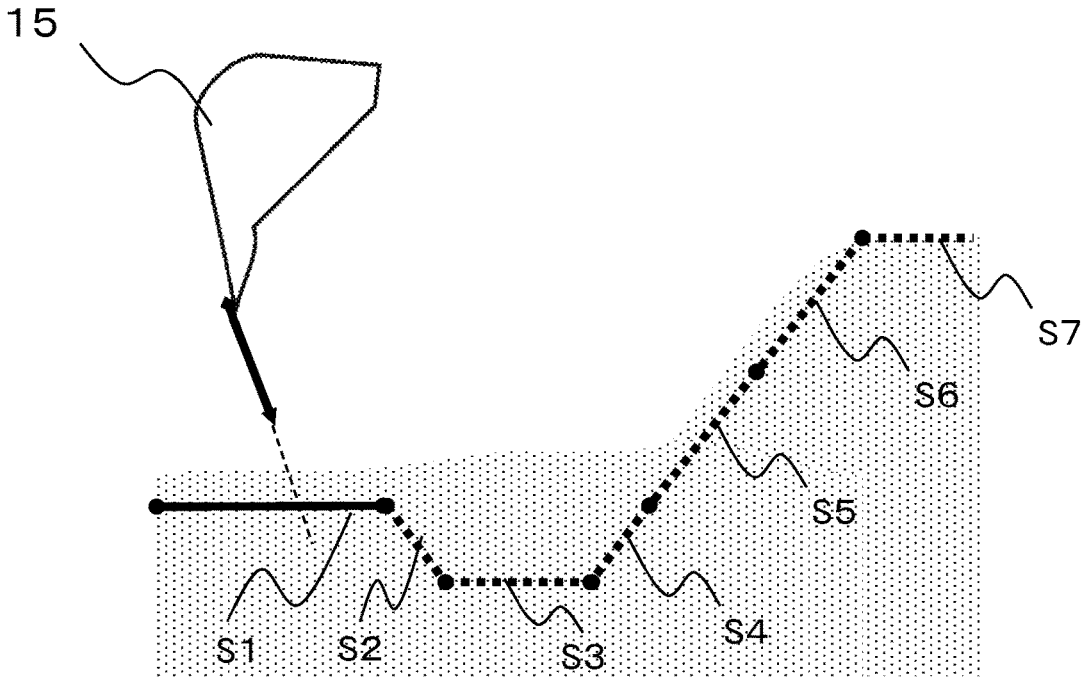
FIG. 7A is a conceptual view explanatory of an operation in one stage performed by the target surface acquisition unit as part of the first embodiment of the construction machine according to the present invention.
Figure 7B:
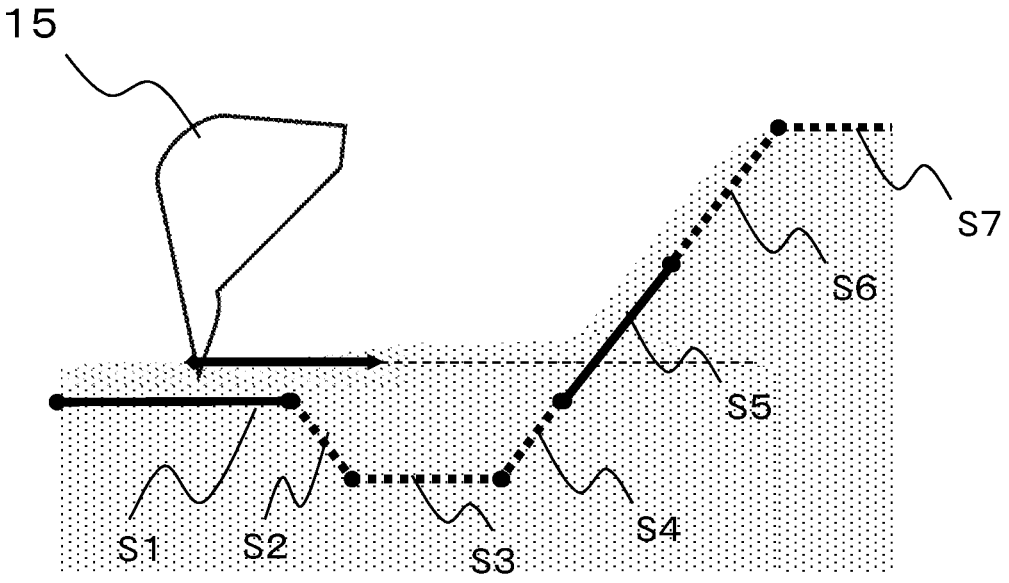
FIG. 7B is a conceptual view explanatory of an operation in another stage performed by the target surface acquisition unit as part of the first embodiment of the construction machine according to the present invention.
Figure 7C:
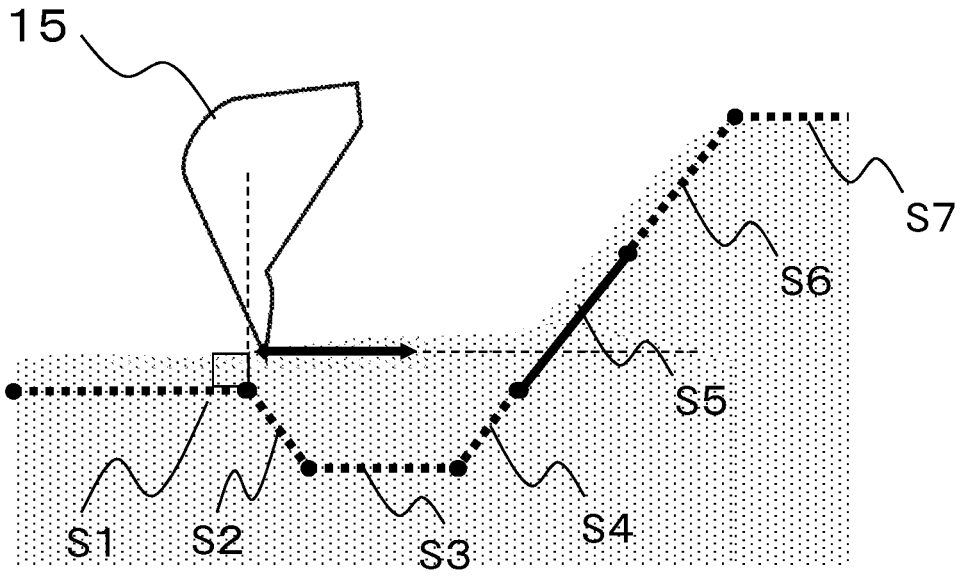
FIG. 7C is a conceptual view explanatory of an operation in still another stage performed by the target surface acquisition unit as part of the first embodiment of the construction machine according to the present invention.
Figure 15:
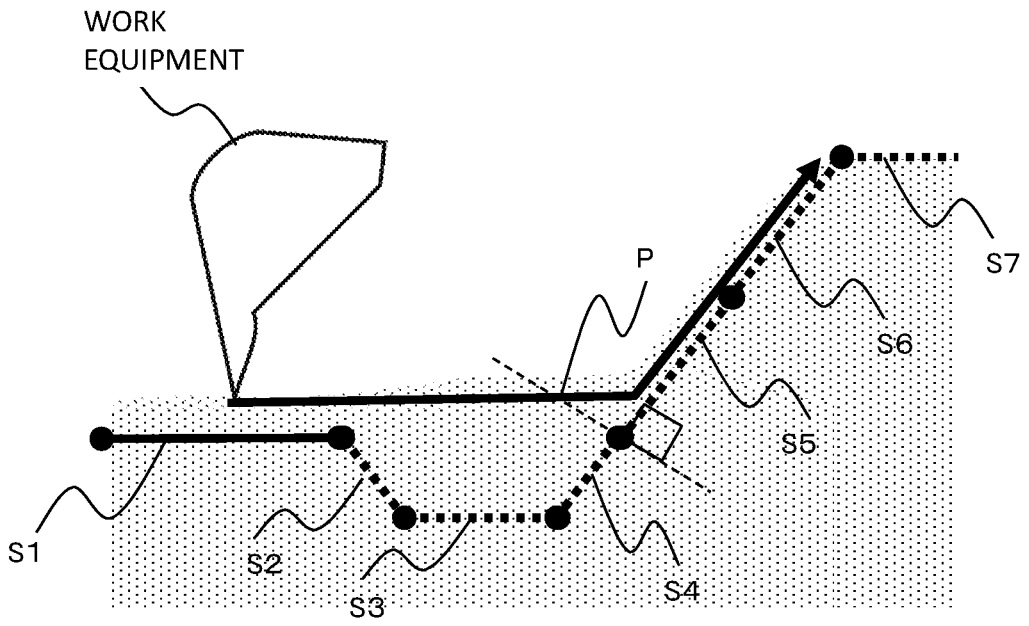
FIG. 15 is a conceptual view explanatory of the operations of the target surface acquisition method with the existing excavation support device.

An example of the operations performed by the target surface acquisition unit 140 of the first embodiment is described below using FIGS. 7A to 7C. FIG. 7A is a conceptual view explanatory of an operation in one stage performed by the target surface acquisition unit as part of the first embodiment of the construction machine according to the present invention. FIG. 7B is a conceptual view explanatory of an operation in another stage performed by the target surface acquisition unit as part of the first embodiment of the construction machine according to the present invention. FIG. 7C is a conceptual view explanatory of an operation in still another stage performed by the target surface acquisition unit as part of the first embodiment of the construction machine according to the present invention. FIGS. 7A through 7C, as with FIG. 15, each show a cross-sectional shape of a road along which a drain ditch is to be constructed. The shading in each of the drawings indicates the present shape. Reference characters S1 to S7 in the drawings indicate the cross sections of design surfaces.

FIG. 7A shows the stage in which the work equipment 15 approaches the design surface S1. At this time, the velocity vector of the work equipment 15 indicated by the arrow in FIG. 7A points to the design surface S1. Thus the estimated target surface calculation unit 141 selects the design surface S1 as the estimated target surface. The distance between the work equipment 15 and the design surface S1 is calculated as the estimated target surface distance.

In initial calculations by the principal target surface calculation unit 142, the principal target surface distance is handled as a maximum value in the calculations because there is no principal target surface. Thus in step S1422 in the processing sequence of FIG. 6, the estimated target surface distance is determined to be shorter than the principal target surface distance of the preceding control cycle. In step S1423, the design surface S1 that is the estimated target surface is selected as the principal target surface.

Returning to FIG. 7A, the design surface S1 is thereafter kept selected as the estimated target surface, and the design surface S1 is kept retained as the principal target surface until the direction of the velocity vector of the work equipment 15 is changed.

FIG. 7B shows the stage in which the work equipment 15 is moved horizontally along the design surface S1. At this time, the velocity vector of the work equipment 15 indicated by the arrow in the drawing points to the design surface S5. Thus the estimated target surface calculation unit 141 selects the design surface S5 as the estimated target surface, and calculates the distance between the work equipment 15 and the design surface S5 as the estimated target surface distance.

During the calculation by the principal target surface calculation unit 142, the design surface S1 is set as the principal target surface, and the distance between the work equipment 15 and the design surface S1 is determined to be shorter than the distance between the work equipment 15 and the design surface S5. Thus in step S1422 of the processing sequence in FIG. 6, the estimated target surface distance is determined to be not shorter than the principal target surface distance of the preceding control cycle. As a result, in step S1424, the design surface S1 is kept retained as the principal target surface.

FIG. 7C shows the stage in which the work equipment 15 is moved horizontally along the design surface S1 until the work equipment 15 is off the upper surface of the design surface S1. At this time, the design surface corresponding to the principal target surface is determined to be absent in the in-plane determination of step S1428 in the processing sequence of FIG. 6. The principal target surface distance is set to be an invalid value with no principal design surface. In step S1422 in the next control cycle, the estimated target surface distance is determined to be shorter than the principal target surface distance of the preceding control cycle. In step S1423, the design surface S5 that is the estimated target surface is selected as the principal target surface.

As described above, the target surface acquisition unit 140 of the first embodiment selects the design surface S1 as both the estimated target surface and the principal target surface in the stage of FIG. 7A; the target surface acquisition unit 140 selects the design surface S1 as the principal target surface while selects the design surface S5 as the estimated target surface in the stage of FIG. 7B; and the target surface acquisition unit 140 selects the design surface S5 as both the estimated target surface and the principal target surface in the stage of FIG. 7C. These selections are performed with accuracy. In the stage of FIG. 7C, it is possible to avoid selecting a design surface that is close to but moving away from the work equipment 15, such as the design surface S2, as the principal target surface or as the estimated target surface.

Operation Control Unit

Figure 8:
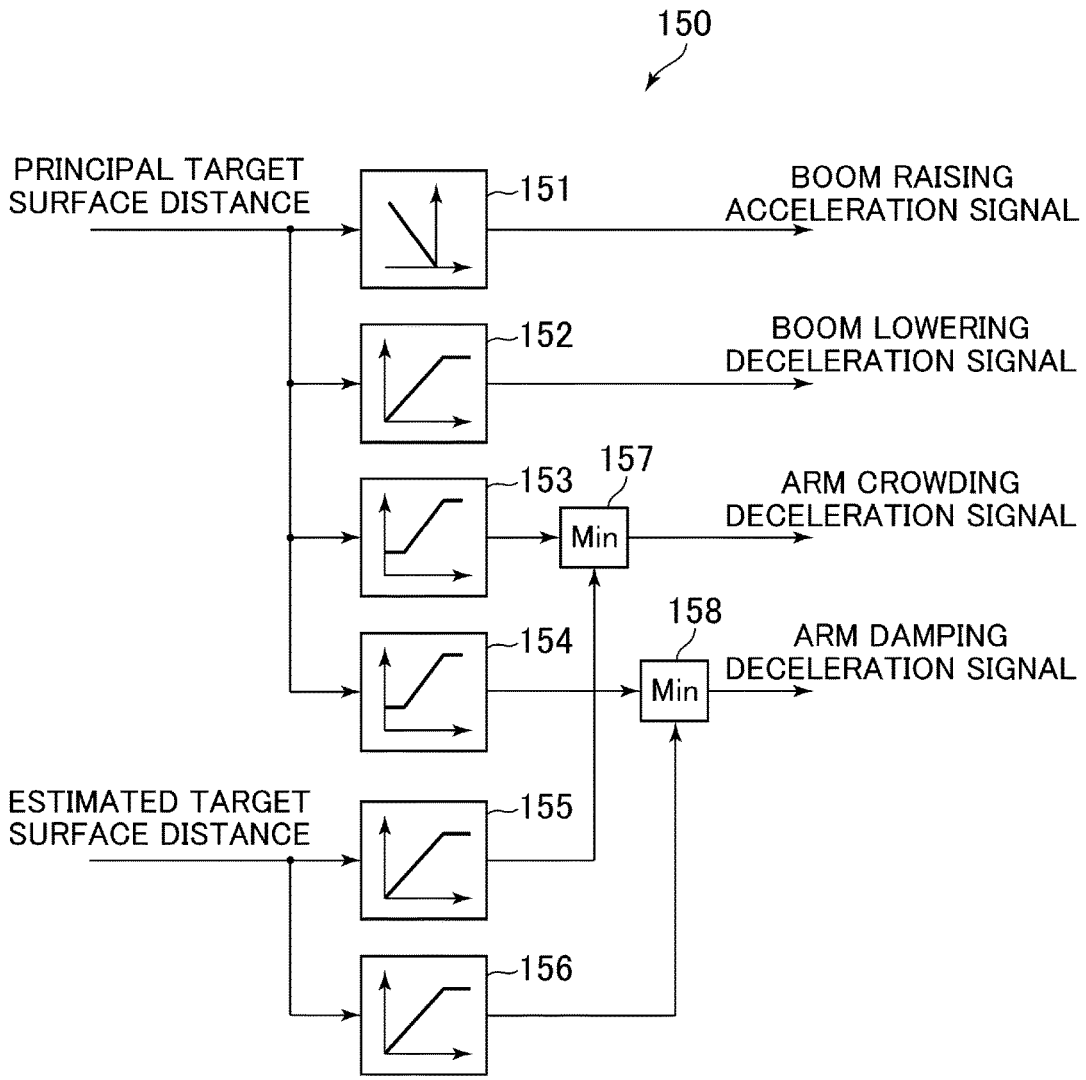
FIG. 8 is a block diagram showing an operation control unit of the controller as part of the first embodiment of the construction machine according to the present invention.

An example of the calculations performed by the operation control unit 150 is descried below using FIG. 8. FIG. 8 is a block diagram showing the operation control unit of the controller as part of the first embodiment of the construction machine according to the present invention.

The operation control unit 150 includes four function generators 151 to 154 that input the principal target surface distance signal and output signals according to predetermined maps, two function generators 155 and 156 that input the estimated target surface distance signal and output signals as per predetermined maps, and minimum value selectors 157 and 158. The operation control unit 150 prevents the work equipment 15 from intruding into the target surface by correcting (inhibiting) the velocity of the work equipment 15 in accordance with the principal target surface distance signal and the estimated target surface distance signal.

Using their predetermined maps, the function generators 151 and 152 calculate and output the boom raising acceleration signal and the boom lowering deceleration signal, respectively, in accordance with the principal target surface distance. The map of the function generator 151 is set in such a manner that the greater the principal target surface distance in negative value (the more the work equipment 15 intrudes into the principal target surface), the higher the boom raising velocity becomes. The map of the function generator 152 is set in such a manner that the shorter the principal target surface distance in positive value (the closer the work equipment 15 is to the principal target surface), the lower the boom lowering velocity becomes. These settings allow the boom velocity to be adjusted so as to let the work equipment 15 follow the principal target surface.

Using their predetermined maps, the function generators 153 and 154 calculate a first arm crowding deceleration signal and a first arm damping deceleration signal, respectively, in accordance with the principal target surface distance. The function generators 153 and 154 output the first arm crowding deceleration signal and the first arm damping deceleration signal to the minimum value selectors 157 and 158, respectively. The maps of the function generators 153 and 154 are both set in such a manner that the shorter the principal target surface distance, the lower the arm crowding velocity or the arm damping velocity becomes. These settings prevent the work equipment 15 from intruding into the principal target surface.

Using their predetermined maps, the function generators 155 and 156 calculate a second arm crowding deceleration signal and a second arm damping deceleration signal, respectively, in accordance with the estimated target surface distance. The function generators 155 and 156 output the second arm crowding deceleration signal and the second arm damping deceleration signal to the minimum value selectors 157 and 158, respectively. The maps of the function generators 155 and 156 are both set in such a manner that the shorter the estimated target surface distance, the lower the arm crowding velocity or the arm damping velocity becomes. These settings prevent the work equipment 15 from intruding into the estimated target surface.

The minimum value selector 157 selects the smaller of the first and the second arm crowding deceleration signals that have been input, and outputs the selected signal as the arm crowding deceleration signal. Likewise, the minimum value selector 158 selects the smaller of the first and the second arm damping deceleration signals that have been input, and outputs the selected signal as the arm damping deceleration signal.

The function generators 155 and 156 may be set, in accordance with their maps, in such a manner that when the estimated target surface distance being the input signal is 0, the arm crowding velocity and the arm damping velocity become 0. When, for example, the work equipment 15 moves while raising the boom, these settings inhibit the arm from operating until the direction of the velocity vector of the work equipment 15 is off the estimated target surface at that point. The work equipment 15 is thus prevented from intruding into the estimated target surface more reliably. When the direction of the velocity vector of the work equipment 15 is off the estimated target surface at that point, the design surface is no longer the estimated target surface, so that the arm may start operating.

The operation control unit 150 of the first embodiment is described above using as an example the velocity control of the boom 11 and the arm 12. However, this is not limitative of the present invention. Alternatively, the velocity of the work equipment 15 may be inhibited by controlling the velocity of the bucket 8 constituting part of the work equipment 15.

Display Unit

Figure 9:
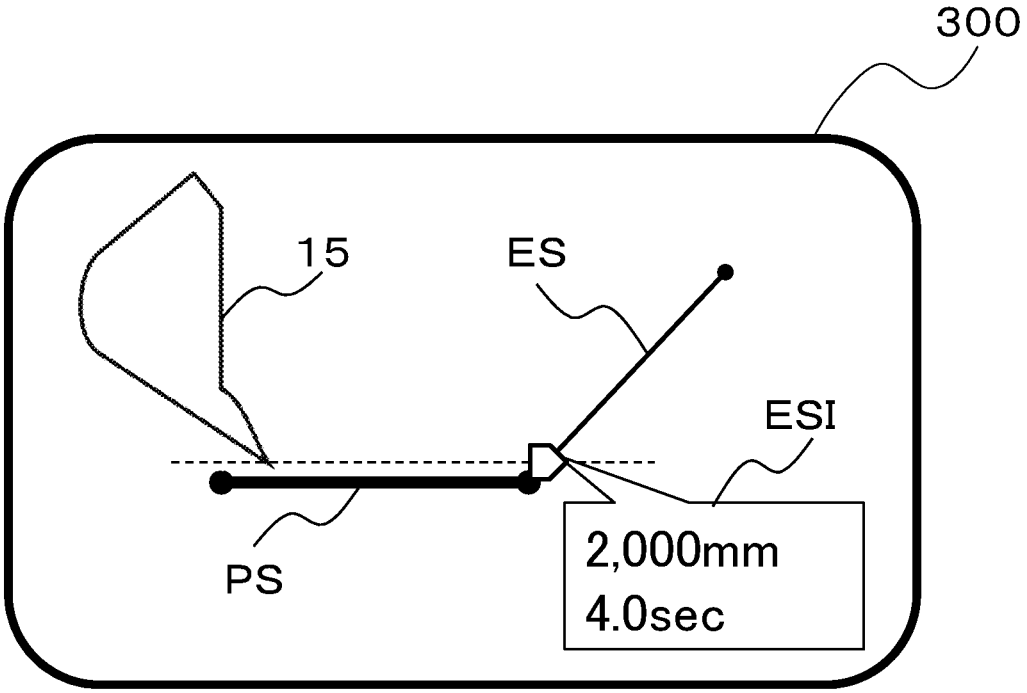
FIG. 9 is a conceptual view showing typical display content appearing on a display unit when the first embodiment of the construction machine according to the present invention is applied to two adjacent design surfaces.
Figure 10:
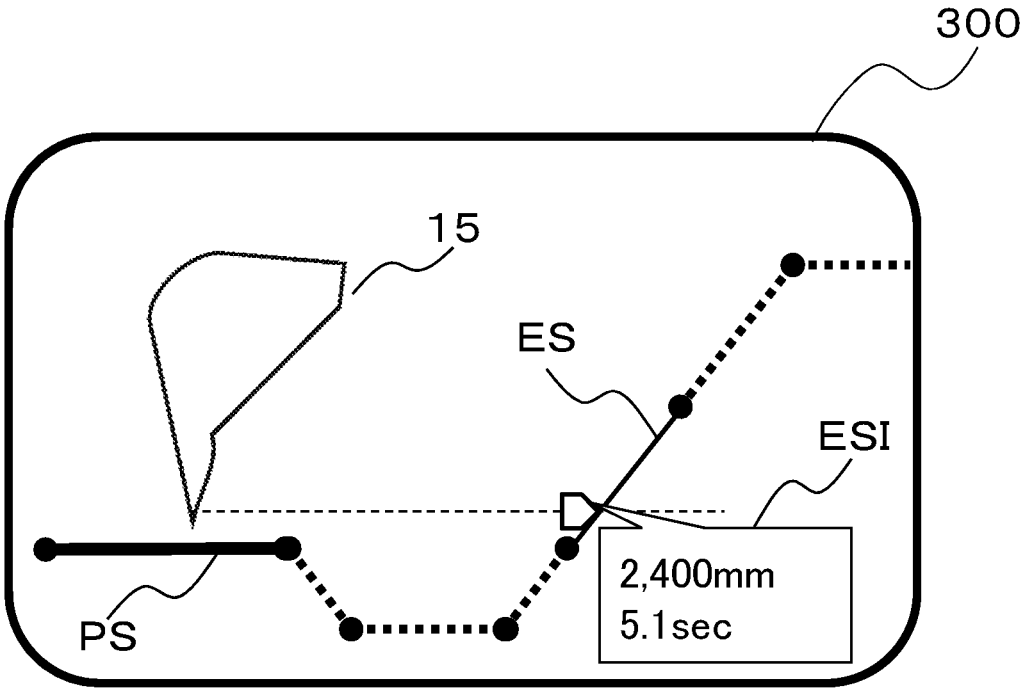
FIG. 10 is a conceptual view showing typical display content appearing on the display unit when the first embodiment of the construction machine according to the present invention is applied to a complicated design surface.
Figure 11:
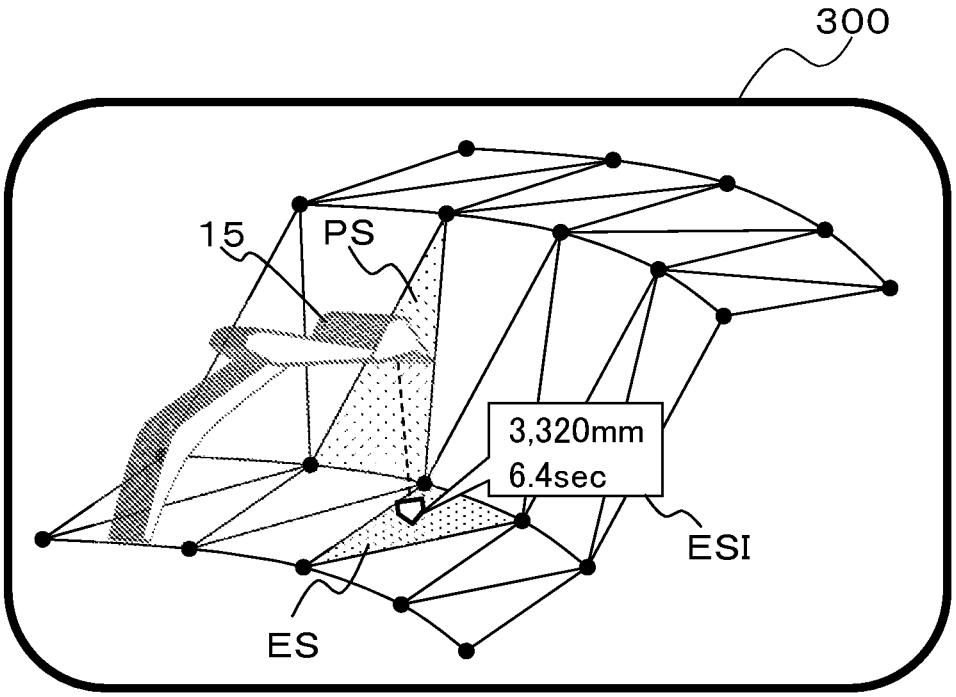
FIG. 11 is a conceptual view showing typical display content appearing on the display unit when the first embodiment of the construction machine according to the present invention is applied to excavation involving swinging.

Described below using the accompanying drawings is the display unit 300 constituting part of the first embodiment of the construction machine according to the present invention. FIG. 9 is a conceptual view showing typical display content appearing on the display unit when the first embodiment of the construction machine according to the present invention is applied to two adjacent design surfaces. FIG. 10 is a conceptual view showing typical display content appearing on the display unit when the first embodiment of the construction machine according to the present invention is applied to a complicated design surface. FIG. 11 is a conceptual view showing typical display content appearing on the display unit when the first embodiment of the construction machine according to the present invention is applied to excavation involving swinging. Of the reference characters in FIGS. 9 to 11, those also found in FIGS. 1 to 8 denote the same or corresponding parts that will not be discussed further in detail.

In the first embodiment, the display unit 300 displays the position of the work equipment 15, the position of a principal target surface PS, the position of an estimated target surface ES, and estimated target surface information ESI made up of an estimated target surface distance and an estimated target surface arrival time.

In the example of FIG. 9, the display unit 300 displays the estimated target surface ES and the estimated target surface information ESI while informing the operator of the positional relations between the work equipment 15 and the principal target surface PS. The operator is thus informed of when to decelerate the work equipment 15 to prevent its intrusion into the estimated target surface ES, for example.

In the example of FIG. 10, as in the example of FIG. 9, the operator is informed of the need to decelerate the work equipment 15. The excavation support device of the first embodiment permits accurate acquisition of the estimated target surface ES to be displayed or controlled even in a case where multiple design surfaces constitute a complicated design surface. The operator is thus informed of the need to decelerate the work equipment 15 in an easy-to-understand manner.

In the example FIG. 11, as in the examples of FIGS. 9 and 10, the operator is informed of the need to decelerate the work equipment 15. Even in a case where excavation involves swinging, the excavation support device of the first embodiment permits acquisition of the estimated target surface ES on the basis of the work equipment velocity vector that is a three-dimensional vector in the three-dimensional coordinate system defining design surfaces. The estimated target surface ES is thus acquired with accuracy, which makes the operator to be informed of the need to decelerate the work equipment 15.

With the first embodiment, as shown in FIGS. 9 to 11, the estimated target surface arrival time is displayed as the estimated target surface information ESI. The operator is thus informed of the need to decelerate the work equipment 15 more effectively than if the estimated target surface distance alone is displayed without regard to the velocity of the work equipment 15. This inhibits the work equipment 15 from intruding into the estimated target surface ES.

The above-described first embodiment of the construction machine according to the present invention acquires the target surface by selecting from multiple design surfaces one that is highly likely to come into contact with the work equipment 15. In this manner, the target surface to be displayed or controlled is acquired efficiently and accurately.

The first embodiment is described above using an example in which both the estimated target surface distance and the estimated target surface arrival time are displayed as the estimated target surface information ESI on the display unit 300. However, this is not limitative of the present invention. Alternatively, either the estimated target surface distance or the estimated target surface arrival time need only be displayed.

The first embodiment is also described above using an example in which the excavation support device includes the display unit 300 and the operation control unit 150 of the controller. However, this is not limitative of the present invention. Alternatively, at least either the display unit 300 or the operation control unit 150 of the controller need only be provided.

Second Embodiment

Figure 12:
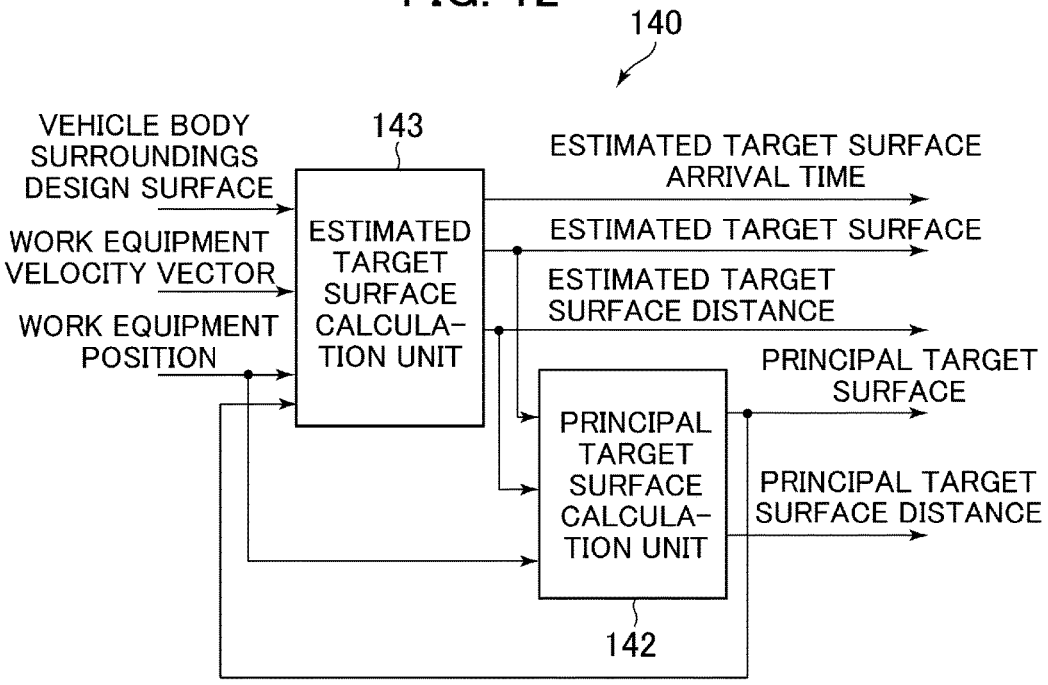
FIG. 12 is a block diagram showing a target surface acquisition unit of a controller as part of a second embodiment of the construction machine according to the present invention.
Figure 13A:
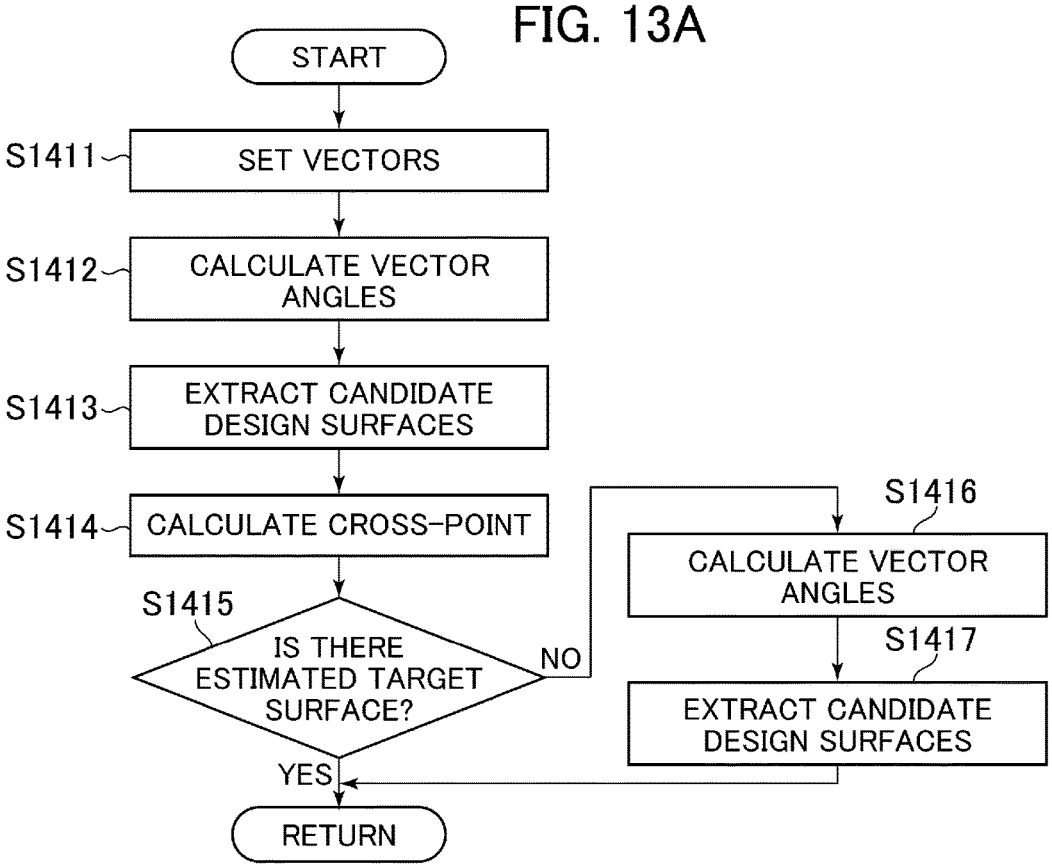
FIG. 13A is a flowchart showing the processing sequence of an estimated target surface calculation unit as part of the second embodiment of the construction machine according to the present invention.
Figure 13B:
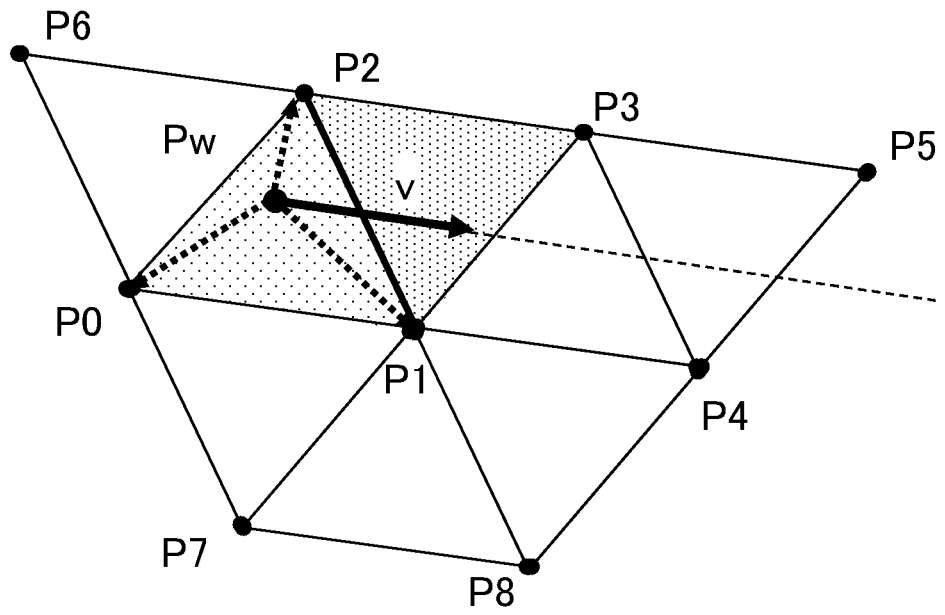
FIG. 13B is a conceptual view explanatory of a typical process performed by the estimated target surface calculation unit as part of the second embodiment of the construction machine according to the present invention.

A second embodiment of the construction machine according to the present invention is described below using the accompanying drawings. FIG. 12 is a block diagram showing a target surface acquisition unit of the controller constituting part of the second embodiment of the construction machine according to the present invention. FIG. 13A is a flowchart showing the processing sequence of an estimated target surface calculation unit as part of the second embodiment of the construction machine according to the present invention. FIG. 13B is a conceptual view explanatory of a typical process performed by the estimated target surface calculation unit as part of the second embodiment of the construction machine according to the present invention. Of the reference characters in FIGS. 12 to 13B, those also found in FIGS. 1 to 11 denote the same or corresponding parts that will not be discussed further in detail.

In the second embodiment of the construction machine according to the present invention, the excavation support device is structured substantially the same as in the first embodiment, except that the target surface acquisition unit 140 includes an estimated target surface calculation unit 143 that inputs a principal target surface signal calculated by the principal target surface calculation unit 142 and that performs a process different from the process of the estimated target surface calculation unit 141 in the first embodiment.

As shown in FIG. 12, the target surface acquisition unit 140 in the second embodiment of the construction machine according to the present invention includes the estimated target surface calculation unit 143 and the principal target surface calculation unit 142. The estimated target surface calculation unit 143 inputs the vehicle body surroundings design surface signal from the design surface information storage unit 110, the work equipment position signal from the work equipment position acquisition unit 120, the work equipment velocity vector signal from the work equipment velocity vector acquisition unit 130, and the principal target surface signal from the principal target surface calculation unit 142. The estimated target surface calculation unit 143 proceeds to calculate the estimated target surface, estimated target surface distance, and estimated target surface arrival time and to output the signals thus calculated. The principal target surface calculation unit 142 is the same as in the first embodiment and thus will not be discussed further.

An example of the calculations performed by the estimated target surface calculation unit 143 is described below using FIGS. 13A and 13B. Steps S1411 to S1414 in FIG. 13A are the same as in the first embodiment and thus will not be discussed further. In step S1415, the estimated target surface calculation unit 143 determines whether the estimated target surface is acquired. If it is determined that the estimated target surface is acquired, the estimated target surface calculation unit 143 returns to the first step. Otherwise the estimated target surface calculation unit 143 goes to step S1416. Typically, the estimated target surface is not acquired if the design surface is in parallel with the work equipment velocity vector v, as shown in FIG. 13B. In FIG. 13B, the design surface P0P1P2 represents the principal target surface.

In step S1416, the estimated target surface calculation unit 143 performs vector angle calculation. Specifically, as shown in FIG. 13B, the estimated target surface calculation unit 143 sets coordinate point directional vectors (indicated by dotted-line arrows in FIG. 13B) from point Pw, which is the feature point on the work equipment, to each of coordinate points P0, P1 and P2 constituting the principal target surface P0P1P2. On the basis of the inner product of the work equipment velocity vector v and each coordinate point directional vector, the estimated target surface calculation unit 143 calculates the angles between the vectors.

In step S1417, the estimated target surface calculation unit 143 extracts an estimated target surface. Specifically, as shown in FIG. 13B, on the basis of the angles between the work equipment velocity vector v and each of the coordinate point directional vectors calculated in step S1416, the estimated target surface calculation unit 143 selects the coordinate point constituting the coordinate point directional vector having the smallest angle and the coordinate point constituting the coordinate point directional vector having the second-smallest angle, and extracts the design surface having these coordinate points as the estimated target surface. The estimated target surface calculation unit 143 further outputs as invalid values the estimated target surface arrival time and the estimated target surface distance.

When performing the above calculations, the estimated target surface calculation unit 143 selects as the estimated target surface the design surface P1P2P3 that is in the direction in which the work equipment 15 advances and that is close to the work equipment 15, without selecting design surfaces P0P2P6, P0P1P7 or P1P7P8. This permits accurate acquisition of the design surface that is potentially the next principal target surface.

The second embodiment of the construction machine according to the present invention thus provides the same effects as the first embodiment.

The present invention is not limited to the embodiments discussed above and may also be implemented in diverse variations. The embodiments above have been explained as detailed examples helping this invention to be better understood. The present invention, when embodied, is not necessarily limited to any embodiment that includes all the structures described above. Part of the structure of one embodiment may be replaced with the structure of another embodiment. The structure of a given embodiment may be supplemented with the structure of another embodiment. Part of the structure of each embodiment may be supplemented with, emptied of, or replaced by another structure.

What is claimed is:

1. A construction machine comprising:

a vehicle body;

work equipment including a boom attached tiltably to the vehicle body, an arm attached tiltably to the boom, and a bucket attached tiltably to the arm;

a control lever device configured to operate the boom, the arm, and the bucket; and a controller configured to:

store one or more three-dimensional target shapes as a plurality of design surfaces;

estimate a position of a feature point of the work equipment;

estimate a velocity vector of the work equipment on the basis of an operation amount of the control lever device;

acquire a principal target surface from the stored design surfaces on the basis of the position of the feature point of the work equipment and on the basis of the velocity vector of the work equipment;

acquire an estimated target surface on the basis of the stored design surfaces; and modify the principal target surface to be the estimated target surface in response to predefined conditions, wherein acquisition of the estimated target surface includes determining one of the stored design surfaces in which a cross-point with the velocity vector of the work equipment exists in a plane thereof as the estimated target surface, and wherein the controller is further configured to:

calculate a plurality of coordinate point directional vectors from the position of the feature point of the work equipment to a plurality of coordinate points constituting the principal target surface;

select the coordinate points on the basis of angles between the work equipment velocity vector and the coordinate point directional vectors; and determine the one of the design surfaces including the selected coordinate points as the estimated target surface.

2. The construction machine according to claim 1, wherein the controller is further configured to:

correct a velocity of the work equipment in accordance with positional relations between the position of the feature point of the work equipment and the principal target surface, wherein the velocity of the work equipment is corrected on the basis of the distance between the estimated target surface and the position of the feature point of the work equipment.

3. The construction machine according to claim 1, wherein the controller is further configured to:

when the distance between the position of the feature point of the work equipment and the estimated target surface is equal to or greater than a distance between the position of the feature point of the work equipment and the principal target surface, retain the acquired principal target surface; and when the distance between the position of the feature point of the work equipment and the estimated target surface is less than the distance between the position of the feature point of the work equipment and the principal target surface, change the estimated target surface to a new principal target surface.

4. The construction machine according to claim 1, further comprising:

a display unit configured to display positional relations between the position of the feature point of the work equipment and the principal target surface, wherein the display unit displays, as estimated target surface information, at least one of distance information indicative of the distance between the position of the feature point of the work equipment and the estimated target surface or time information indicative of the time the work equipment arrives at the estimated target surface.

* * * * *